US005775079A

United States Patent [19]

Hoover

[11] Patent Number: 5,775,079

[45] Date of Patent: Jul. 7, 1998

[54] APPARATUS FOR IMPARTING VIRTUAL TWIST TO STRAND MATERIAL AND METHOD OF IMPARTING SAME

[75] Inventor: D. Lynn Hoover, Cramerton, N.C.

[73] Assignee: American Linc Corporation, Gastonia, N.C.

[21] Appl. No.: 843,797

[22] Filed: Apr. 21, 1997

[51] Int. Cl.[6] ..... D01H 7/02

[52] U.S. Cl. ..... 57/59; 57/1 R; 57/60; 57/66; 57/283; 57/293; 57/311

[58] Field of Search ..... 57/1 R, 282, 283, 57/293, 294, 311, 59, 60, 66, 315, 351

[56] References Cited

U.S. PATENT DOCUMENTS

| | | | |
|---|---|---|---|
| 1,302,187 | 4/1919 | Lipps | 57/58.5 |
| 1,772,109 | 8/1930 | Quaas | 57/58.5 |
| 2,430,944 | 11/1947 | Noguera | 57/344 |
| 2,515,299 | 10/1950 | Foster et al. | 57/128 |
| 2,882,674 | 4/1959 | Lenk | 57/66 |
| 3,206,922 | 9/1965 | Nagahara et al. | 57/77.3 |
| 3,298,342 | 1/1967 | Smiley et al. | 57/332 |
| 3,303,639 | 2/1967 | Carter et al. | 57/333 |
| 3,559,392 | 2/1971 | Crouzet | 57/332 |
| 3,583,142 | 6/1971 | Guignard | 57/59 |
| 3,605,393 | 9/1971 | Schroeder | 57/350 |
| 3,943,693 | 3/1976 | Raschle | 57/77.45 |
| 4,322,944 | 4/1982 | Sraitr et al. | 57/350 |
| 4,325,214 | 4/1982 | Zuber | 57/293 |
| 4,414,802 | 11/1983 | Garner et al. | 57/293 |
| 4,509,322 | 4/1985 | Briner et al. | 57/333 |
| 4,574,579 | 3/1986 | Chao | 57/328 |
| 4,607,483 | 8/1986 | Siecke et al. | 57/334 |
| 4,934,133 | 6/1990 | Stalder et al. | 57/333 |
| 4,986,066 | 1/1991 | Morrison | 57/333 |
| 5,094,068 | 3/1992 | Hirao | 57/334 |
| 5,159,806 | 11/1992 | Mori et al. | 57/328 |
| 5,285,624 | 2/1994 | Stahlecker | 57/328 |
| 5,295,349 | 3/1994 | Okamoto | 57/333 |
| 5,475,907 | 12/1995 | Hoover | 28/219 |
| 5,483,730 | 1/1996 | Hoover | 28/289 |

*Primary Examiner*—William Stryjewski
*Attorney, Agent, or Firm*—Allen, Dyer, Doppelt, Milbrath & Gilchrist

[57] ABSTRACT

An apparatus and method for imparting a virtual twist to strand material is provided. The apparatus preferably has a textile strand supply source for supplying a plurality of strands of textile strand material and a virtual twister positioned downstream from the strand supply source for virtually twisting the plurality of strands supplied from the strand supply source so as to impart cohesiveness among the plurality of strands. The virtual twister preferably has a strand guide positioned to guide the plurality of strands downstream and includes a strand twist position and a strand release position. The virtual twister also preferably has a strand guide drive connected to the strand guide for rotatingly driving the strand guide in only one direction so as to impart a twist to the plurality of strands when the strand guide is in the twist position and so as to release the twist of the plurality of strands when the strand guide is in the release position to thereby impart a virtual twist to the plurality of strands of textile strand material.

48 Claims, 5 Drawing Sheets

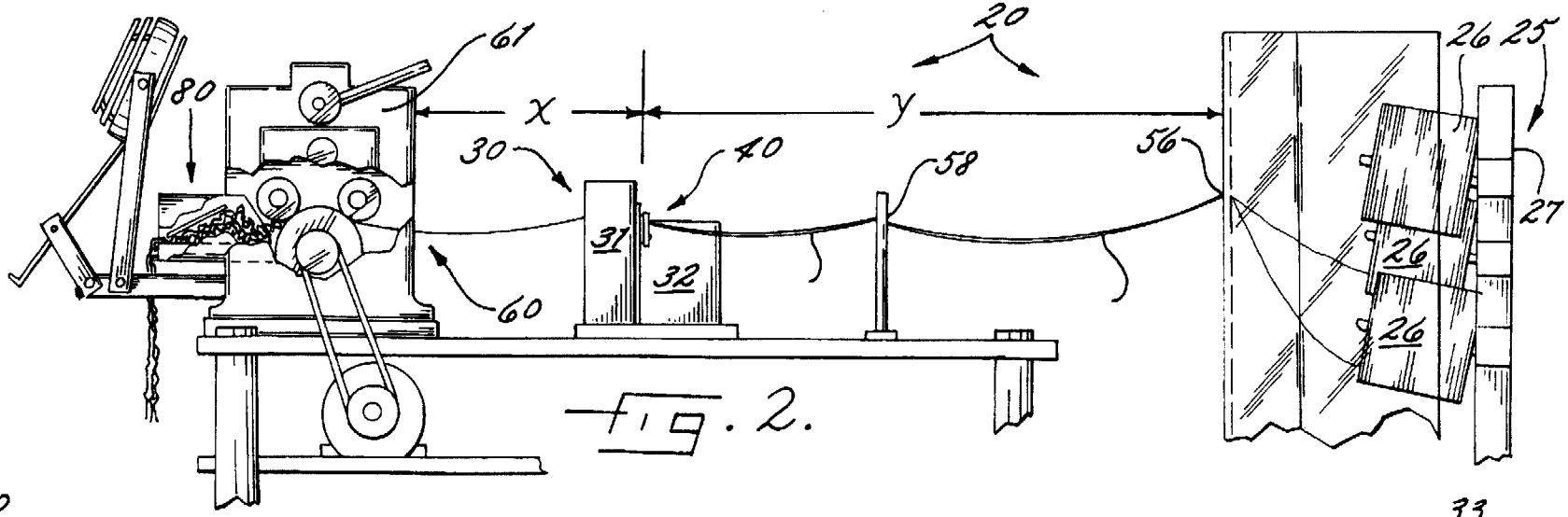
FIG. 2.
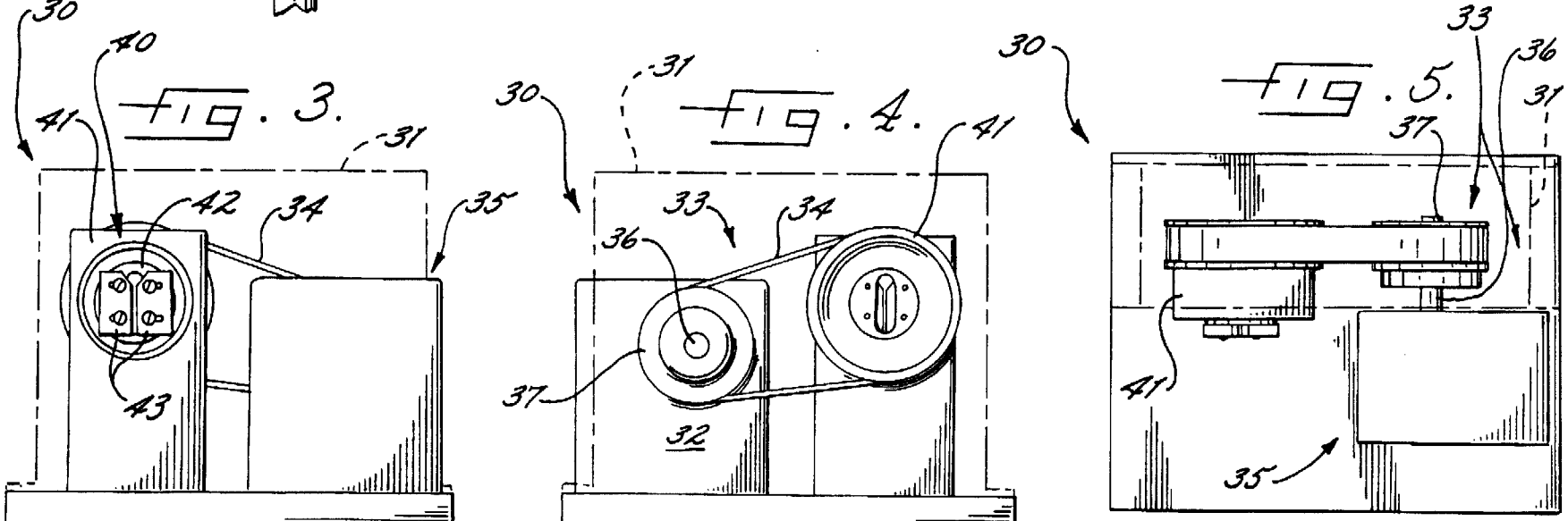
FIG. 5.
FIG. 4.
FIG. 3.

APPARATUS FOR IMPARTING VIRTUAL TWIST TO STRAND MATERIAL AND METHOD OF IMPARTING SAME

FIELD OF THE INVENTION

This invention is related to the textile industry and more particularly to the field of handling textile strand material.

BACKGROUND OF THE INVENTION

Over the years, the handling of strand material such as yarn or sliver in the textile industry has impacted many aspects of applications of the strand material as well as the processes for manufacturing various textile related products. During the process of movement of yarn or sliver in the production processes, it is desirable that the yarn or sliver strands be somewhat cohesive and stay close to each other during transporting of the yarn or sliver. Nevertheless, some types of strand material such as yarn, e.g., continuous filament, or sliver which contain synthetic fibers can have considerable problems in staying together. In other words, the synthetic fibers of a plurality of strands of strand material can have a tendency to repel or separate from each other.

Various devices over the years have been developed for applying a false twist to strand material in the textile industry such as rotating a plurality of strands in one direction and then counter-rotating or unwinding the strands in the opposite direction. This process, however, can require additional cams, various linkages, and motors for the sliver or yarn handling phase of a textile production operation. This winding of a plurality of strands in one direction and then unwinding the plurality of strands in the opposite direction can also require synchronization of with the textile production process. The synchronization can become difficult, and timing problems with this synchronization can cause various production problems in the production process.

Also, various air or pneumatic twisting devices have also been developed for imparting a false twist in strand material such as yarn or sliver. These air or pneumatic twisting devices, however, can be ineffective and, therefore, not accomplish the desired result.

SUMMARY OF THE INVENTION

In view of the foregoing, the present invention provides an apparatus and method for imparting a virtual twist to strand material such as yarn or sliver that is relatively less complex and relatively inexpensive. The present invention also advantageously provides better control of the twisting process for the strand material by continuously rotating the yarn in only one direction and at various controlled speeds. The apparatus and methods of present invention thereby advantageously transports a plurality of strands of the strand material downstream in a process so that the plurality of strands, e.g., of continuous filament yarn, cohesively stay closely adjacent or intertwined with each other.

More particularly, an apparatus for imparting a virtual twist to textile strand material is provided according to the present invention. The apparatus preferably has strand supplying means for supplying a plurality of strands of textile strand material and virtual twisting means positioned downstream from the strand supplying means for virtually twisting the plurality of strands supplied from the strand supplying means so as to impart cohesiveness among the plurality of strands. The virtual twisting means has a strand guide positioned to guide the plurality of strands downstream and includes a strand twist position and a strand release position. The virtual twisting means also has strand guide driving means connected to the strand guide for rotatingly driving the strand guide in only one direction so as to impart a twist to the plurality of strands when said strand guide is in the twist position and so as to release the twist of the plurality of strands when the strand guide is in the release position to thereby impart a virtual twist to the plurality of strands of textile strand material.

The strand guide of the apparatus of the present invention preferably includes a guide body having an opening extending therethrough so as to extend the plurality of strands through the guide body. The opening includes narrower portions and wider portions which respectively rotate about an axis responsive to the strand guide driving means so that the plurality of strands move between the narrower and wider portions during rotation of the strand guide and so that the plurality of strands being in the narrower portions defines the twist position and the plurality of strands being in the wider portions defines the release position. The apparatus can also include drawing means positioned downstream from the virtual twisting means for drawing the plurality of strands of strand material through the strand guide of the virtual twisting means.

The present invention also advantageously provides methods of imparting a virtual twist to textile strand material. A method preferably includes guiding a plurality of strands of textile strand material downstream through a strand guide and rotatingly driving the strand guide in only one direction between a strand twist position and a strand release position to thereby impart a virtual twist to the plurality of strands of textile strand material.

Another method of imparting a virtual twist to textile strand material according to the present invention includes guiding textile strand material through a strand guide. The strand guide includes an opening for extending strand material therethrough. The opening has wider portions and narrower portions. The method also includes rotatingly driving the strand guide in only one rotational direction so that strand material slidably moves between the wider and narrower portions of the opening during rotation of the strand guide to thereby impart a virtual twist to strand material.

An apparatus and method for imparting a virtual twist to strand material such as yarn or sliver according to the present invention advantageously rotates the plurality of strands of strand material in only one direction to impart the virtual twist. This rotation in only one direction of a plurality of strands of strand material, for example, advantageously allows the strands to be imparted with varying degrees of twist by rotating the strands at various speeds. The apparatus and method also advantageously do not require extensive timing or synchronization to accomplish the virtual twist in the plurality of strands. The strand twist and release positions, for example, further advantageously allow the plurality of strands to flexibly maintain a natural state which can overcome upstream problems associated with the plurality of strands such as size of the strands, number of twists, distance, and various other upstream process or strand source issues. The apparatus and method therefore are advantageously adaptable to a plurality of sizes of strands and a plurality of rates of production for various textile production processes.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 2 is a side elevational view of an apparatus for imparting a virtual twist to textile strand material such as yarn or sliver according to the present invention;

FIG. 3 is a front elevational view of a virtual twister of an apparatus for imparting a virtual twist to textile strand material such as yarn or sliver according to the present invention;

FIG. 4 is a rear elevational view of a virtual twister having a housing thereof removed of apparatus for imparting a virtual twist to textile strand material such as yarn or sliver according to the present invention;

FIG. 5 is a top plan view of a virtual twister of an apparatus for imparting a virtual twist to textile strand material such as yarn or sliver according to the present invention;

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation if used indicate similar elements in alternative embodiments.

Figure 1:
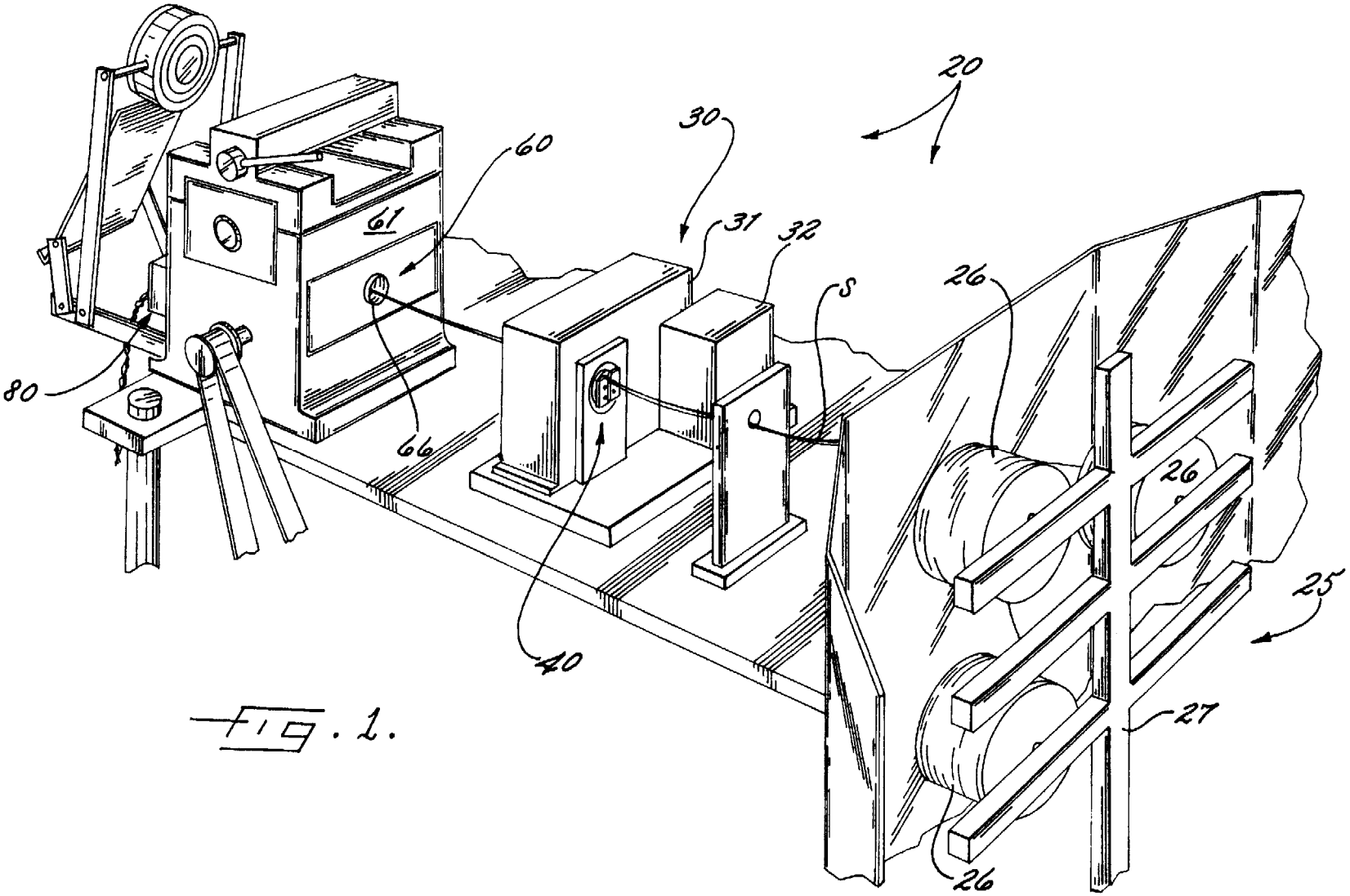
FIG. 1 is a perspective view of an apparatus for imparting a virtual twist to textile strand material such as yarn or sliver according to the present invention.
Figure 6A:
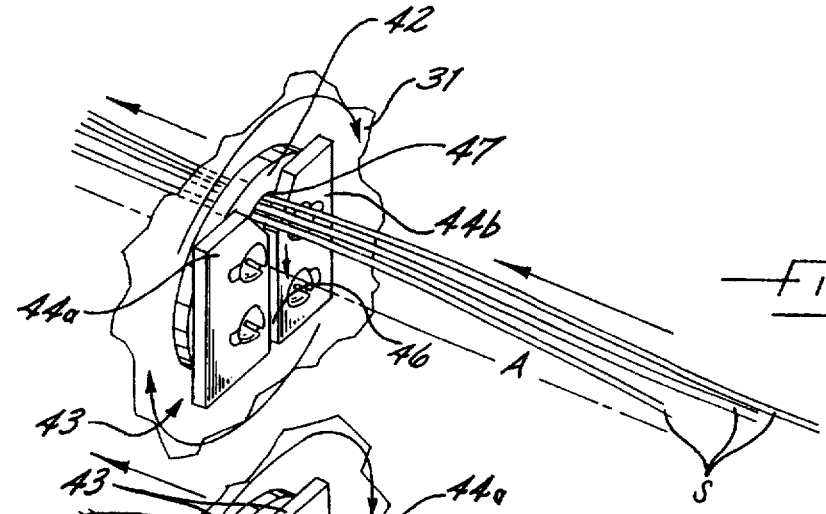
FIGS. 6A–6D are fragmentary perspective views of a strand guide of an apparatus for imparting a virtual twist to textile strand material such as yarn or sliver according to the present invention.
Figure 6B:
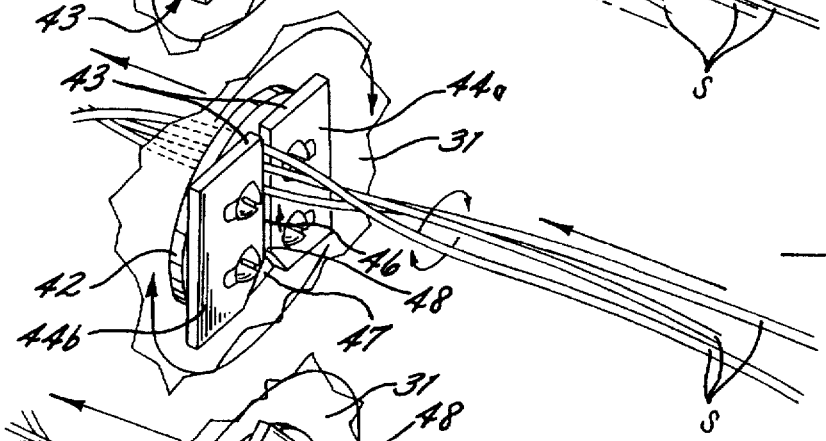
Figure 6C:
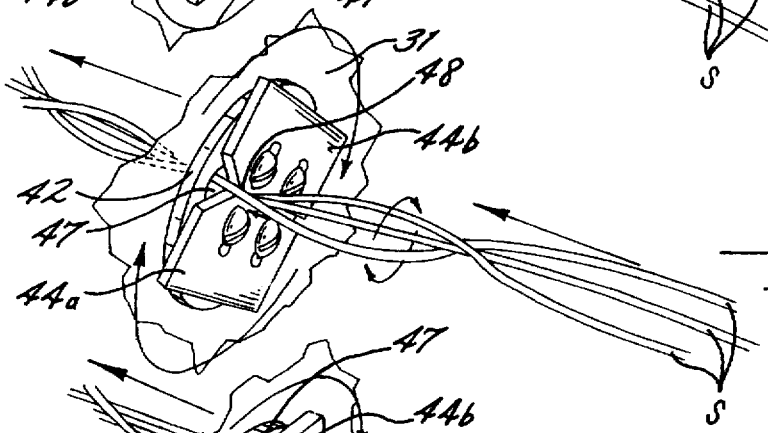
Figure 6D:
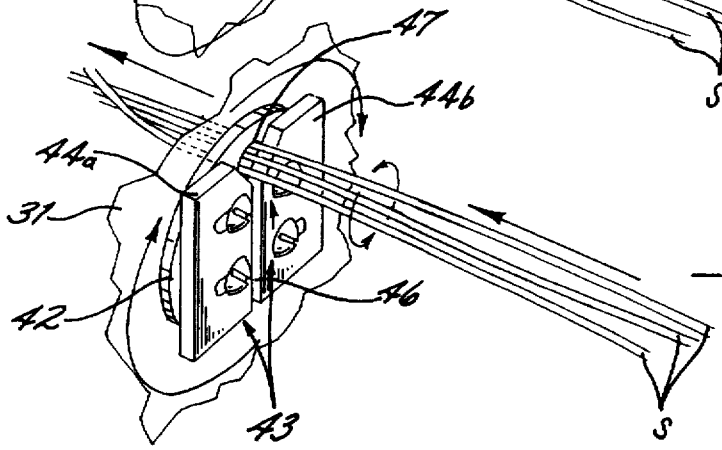

FIGS. 1–2 illustrate an apparatus 20 for imparting a virtual twist to textile strand material such as plurality of strands S of yarn or sliver according to the present invention. The apparatus 20 preferably has strand supplying means 25, e.g., a strand material supply source such as a yarn creel, for supplying a plurality of strands S of textile strand material. The strand supplying means 25, as illustrated, has a plurality, e.g., three, of spools 26 of strand material, e.g., yarn or sliver, positioned on a spool mounting creel, rack, or tree 27. The spools 26 preferably are mounted onto the creel 27 so that the spools 26 are fixed or stationary and the strands S of the yarn or sliver are freely drawn or pulled downstream. The plurality of strands S of textile strand material each preferably include a synthetic fiber of yarn or sliver as understood by those skilled in the art.

As best illustrated in FIGS. 1 and 3–7, the apparatus 20 also has virtual twisting means 30, e.g., a virtual twister, positioned downstream from the strand supplying means 25 for virtually twisting the plurality of strands S supplied from the strand supplying means 25 so as to impart cohesiveness among the plurality of strands S. The virtual twisting means 30 preferably has a strand guide 40 positioned to guide the plurality of strands S downstream. The strand guide 40 preferably includes a strand twist position and a strand release position (see FIGS. 6A–6D). The strand guide 40 also has major portions thereof position in a first housing 31. The virtual twisting means 30 also preferably includes strand guide driving means 33 connected to the strand guide 40 for rotatingly driving the strand guide in only one direction so as to impart a twist to the plurality of strands S when the strand guide 40 is in the twist position and so as to release the twist of the plurality of strands S when the strand guide 40 is in the release position to thereby impart a virtual twist to the plurality of strands S of textile strand material. The strand twist and release positions, for example, advantageously allow the plurality of strands S to flexibly maintain a natural state which can overcome upstream problems associated with the plurality of strands S such as size of the strands, number of twists, distance, and various other upstream process or strand source issues. The strand guide driving means 33 also has portions thereof positioned in the first housing 31 and portions thereof positioned in a second housing 32 (see FIGS. 3–5).

As best illustrated in FIGS. 6A–6D and 7, the strand guide 40 further includes a guide body 41 having an opening 45 extending therethrough so as to extend the plurality of strands S through the guide body 41. The opening 45 includes narrower portions 46 and wider portions 47 which respectively rotate about an axis A responsive to the strand guide driving means 33 so that the plurality of strands S slidably move between the narrower and wider portions 46, 47 during rotation of the strand guide 40 and so that the plurality of strands S being in the narrower portions 46 defines the twist position (see FIG. 6B) and the plurality of strands S being in the wider portions 47 defines the release position (see FIG. 6D). The opening 45 of the guide body 41 preferably also further includes a throat portion 48 positioned between the wider portions 47 and the narrower portions 46 for smoothly guiding the plurality of strands S from the wider portions 47 to the narrower portions 46 during rotation of the strand guide 40. As illustrated and described, the virtual twisting means 30 of the present invention provides an apparatus 20 which advantageously imparts a virtual twist to strand material such as yarn or sliver that is relatively less complex and relatively inexpensive than other known false twist devices or systems. The apparatus 20 of present invention thereby advantageously transports a plurality of strands S of the strand material downstream in a process so that the plurality of strands S, e.g., of continuous filament yarn, cohesively stay closely adjacent or intertwined with each other as the strands S travel through the process.

Figure 7:
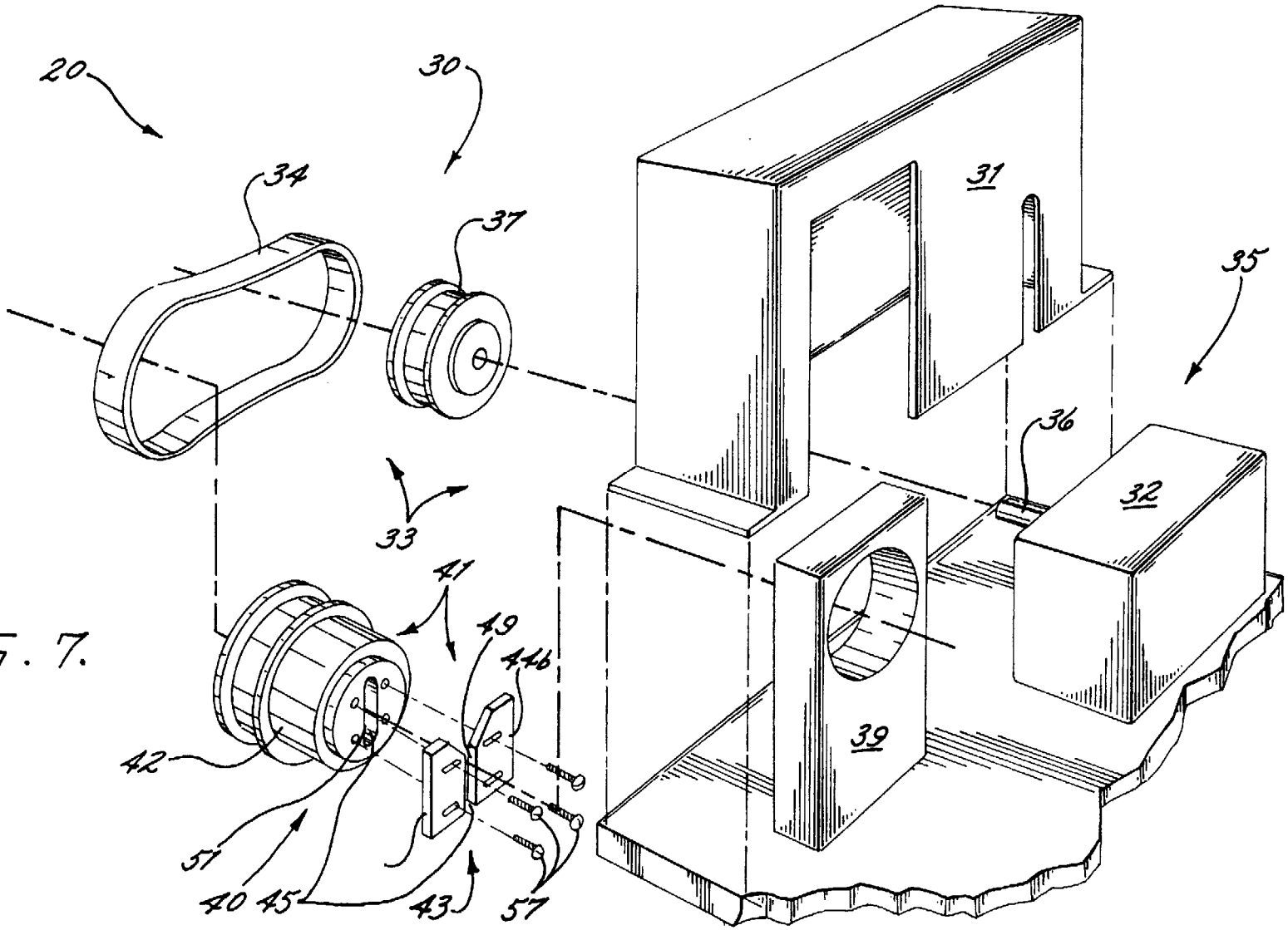
FIG. 7 is an exploded perspective view of a virtual twister of an apparatus for imparting a virtual twist to textile strand material such as yarn or sliver according to the present invention.

As best illustrated in FIG. 7, the guide body 41 of the strand guide 40 is preferably provided by a two-piece or two-portion device formed by a main body member 42, e.g., a first piece, and a plate member 43, e.g., a second piece, detachably connected to the main body member 42. It will be understood by those skilled in the art, however, that a single piece device or other plurality-of-pieces configurations of a device for the guide body 41 would also be within the scope and concepts of the present invention. The guide body 41 is also mounted to a mounting fixture or bracket 39. The opening 45 extends through the main body member 42 and the plate member 43. The plate member 43, as illustrated, is provided by a pair of spaced-apart plates **44*a*, 44*b* each detachably connected to the main body member 42 by threaded fasteners or screws 57 for adjustably forming an open space 49 defined by the space extending between opposing peripheries of the spaced-apart plates 44***a*, 44*b*. The pair of space-apart plates 44*a*, 44*b*, for example, advantageously provide means for adjusting the guiding, positioning, and size of the opening 45 through which the strands S pass through. The opening 45 preferably includes an elongate slot 51 formed in the main body member 42 and the open space 49 extending between the spaceapart plates 44*a*, 44*b* being positioned to coaxially align with the elongate slot 51 (see FIG. 7).

The strand guide driving means 33 preferably includes a variable speed drive 35, e.g., a variable speed motor, for adjustably driving the strand guide 40 at a plurality of speeds so as to advantageously impart a plurality of tightness levels or positions to the twist of the plurality of strands S. The motor preferably has a motor shaft 36 that rotates in a desired direction. A pulley or a drive wheel 37 preferably mounts to the motor shaft 36 and rotates responsive to the rotation of the motor shaft 36. A belt 34 is respectively mounted to the pulley 37 and the main body member 42 of the strand guide 40 so that rotation of the pulley 37 by the motor shaft 36 responsively rotates the belt 34. The rotatingly driven belt 34 thereby rotatingly drives the main body member 42 of the strand guide 40. The strand guide driving means 33 of the virtual twisting means 30 of the apparatus 20 of the present invention also therefore advantageously provides better control of the twisting process for the strand material by continuously rotating the plurality of strands S, e.g., of yarn, in only one direction and at various controlled speeds.

An apparatus 20 of the present invention also preferably includes at least a second strand guide 56, i.e., the strand guide 40 of the virtual twisting means 30 being a first strand guide 40, adjustably positioned between the strand supplying means 25 and the first strand guide 40 for guiding the plurality of strands S from the strand supplying means 25 to the first strand guide 40 so that the adjustable position of the at least a second strand guide 56 advantageously adjusts the tightness of the twist imparted to the plurality of strands S by the virtual twisting means 30. The apparatus 20 also includes a third strand guide 58 positioned between the first and second strand guides 40, 56 for guiding the plurality of strands S between the first strand guide 40 and the at least a second strand guide 56. The opening of the third strand guide 58 preferably is positioned at a slightly higher elevation than the opening 45 of the first strand guide 40 so that the third strand guide 58 cooperates with the first strand guide 40 to thereby advantageously elevate or position the plurality of strands S upwardly so that the strands S are readily held within the wider portions of the opening of the first strand guide 40. This higher elevation, for example, also advantageously allows the strands S to readily move or slide within the opening 45, i.e., between the wider and narrower portions, of the first strand guide 40 during rotation thereof and allows the first strand guide to impart the virtual twist to the strands S. It will be understood by those skilled in the art, however, that various configurations and positions of the strand guides 40, 56, 58 to accomplish this function can be used as well. For example, the opening of the second strand guide 56 can be positioned at an even higher elevation than illustrated and the third strand guide 58 eliminated or the distance between the first and second strand guides 40, 56 can be reduced and the third strand guide 58 eliminated. Also, it will be understood by those skilled in the art that the second and third strand guides 56, 58 of the apparatus 20 of the present invention may not be needed in some manufacturing processes, e.g., where an upstream output of strands produces some or portions of an effect or accomplishes some or portions of the function of either the second or third strand guides 56, 58.

As best illustrated in FIGS. 1–2 and 7–8, although each of the openings of the first, second, and third strand guides 40, 56, 58 can be positioned at different elevations or heights, the openings preferably are aligned in generally the same vertical plane so that the plurality of strands S readily travel therethrough with reduced frictional contact with the inner surfaces of the openings and so that additional tension and twisting advantageously can be reduced. The mounting fixture or bracket 39, for example, enables the first strand guide 40 to extend to a height or level for such positional alignment. As also illustrated in FIG. 2, the opening 45 of the first strand guide 40, as well as the second and third strand guides 56, 58 preferably positionally align in generally the same vertical plane with an opening 66 of the drawing means 60, e.g., in a draw roll housing 61. It will be understood by those skilled in the art that various other positional alignment arrangements can be made for specific textile production processes according to the present invention.

As best illustrated by the side elevational view of FIG. 2, e.g., X and Y distances, the position of the each of the first, second, and third strand guides 40, 56, 58 advantageously can be adjusted and positioned in the production process to impact a desired result. The angle of the second strand guide 56, e.g., closest to the strand source, can be positioned to impact the tightness of the twist in the plurality of strands S and receives the greatest degree of frictional contact with the inner surface of the second strand guide opening. The inner surface of the each of the strand guides 40, 56, 58, but more specifically the second strand guide 56, advantageously can be formed of various surfaces, e.g., ceramic, metal, plastic, so as to reduce frictional contact, improve wear characteristics, or for various desired results by the textile manufacturer according to the present invention.

Figure 8:
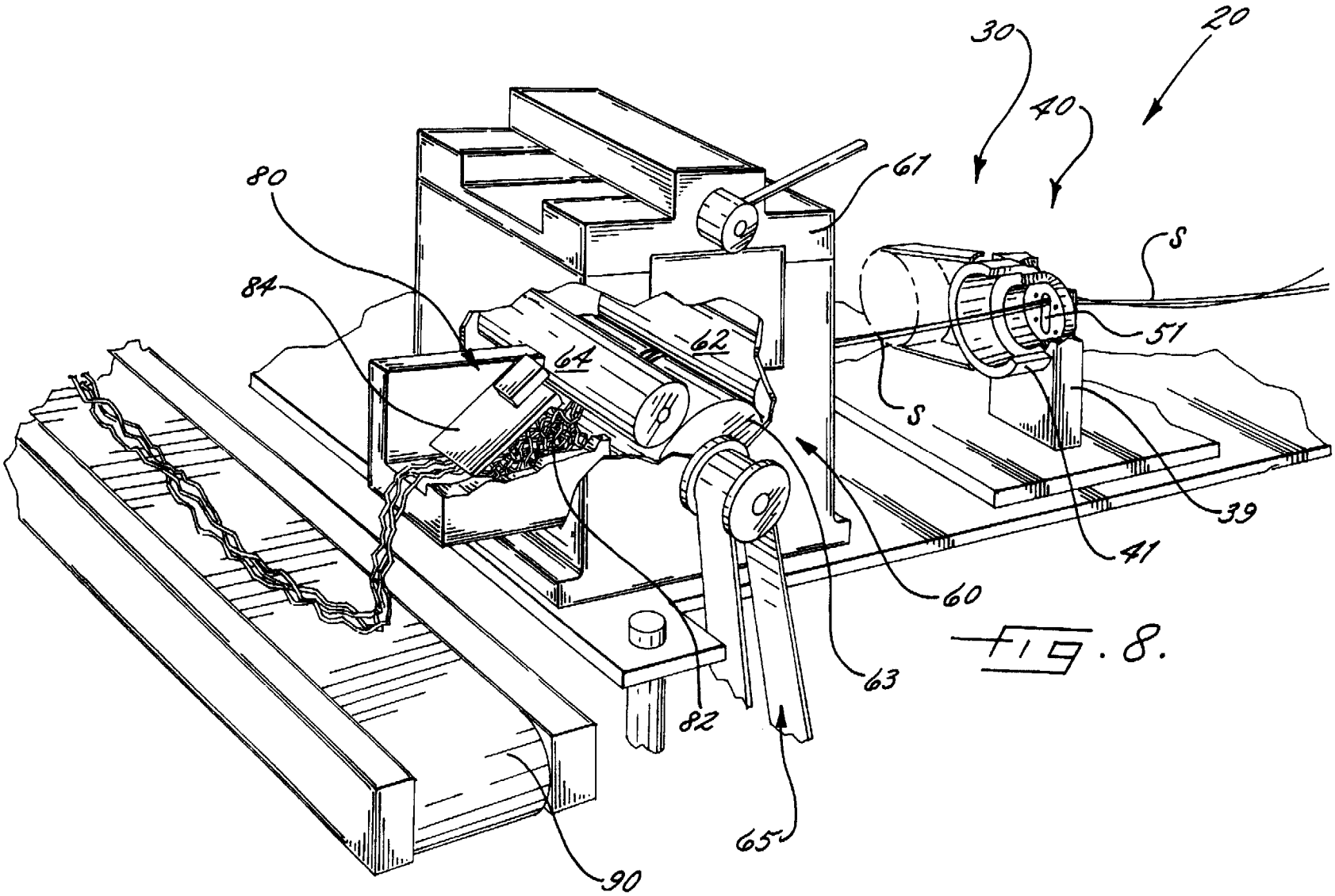
FIG. 8 is a fragmentary perspective view of an apparatus for imparting a virtual twist to textile strand material such as yarn or sliver according to the present invention.

As best illustrated in FIGS. 1 and 8, an apparatus 20 for imparting a virtual twist to a textile strand material can also include strand drawing means 60 positioned downstream from the virtual twisting means 30 for drawing the plurality of strands S downstream from the strand supplying means 25 and through the strand guide 40 of the virtual twisting means 30. As illustrated, the strand drawing means 60 can be provided by a plurality of draw rolls 62, 63, 64, e.g., two or three draw rolls, positioned in a draw roll housing 61 for drawing the plurality of strands S downstream and draw roll driving means 65 connected to the plurality of draw rolls 62, 63, 64, e.g., three draw rolls, for rotatingly driving the plurality of draw rolls 62, 63, 64. It will be understood by those skilled in the art, however, that other mechanical, electrical, or electromechanical devices can be used as well for initiating the transporting of the strands S through the strand guide according to the present invention. The draw roll driving means 65 preferably also advantageously has a variable speed drive, e.g., a variable speed motor, for adjustably driving the plurality of draw rolls 62, 63, 64 at a plurality of speeds. Like the strand guide driving means 33, the draw roll driving means 65, for example, can also include a pulley or drive wheel mounted to a motor shaft and a drive belt extending between the pulley and one of the draw rolls 63 (see, e.g., FIG. 8).

As best illustrated in FIGS. 1, 2, and 8, the apparatus 20 can also include strand crimping means 80 positioned downstream from the drawing means 60 for crimping the plurality of strands S, e.g., continuous filamentary yarn. The crimping means 80, for example, can include a container 82, e.g.,a box or a can, positioned adjacent or in the same housing 61 as the drawing means 60 for temporarily collecting and storing the plurality of strands S in a confined space after being drawn through the plurality of draw rolls 62, 63. The confined space of the container 82, in turn, causes crimps, undulations, or various degrees of contractions to be formed in the accumulated strands (see, e.g., FIG. 8). The container 82 preferably has a strand discharge door 84 positioned on a downstream end of the container 82 so that when a predetermined amount of the plurality of strands S are accumulated in the container 82, the weight of the accumulated strands opens the strand discharge door 84 so that the accumulated strands are discharged downstream. The strand discharge door 84 preferably includes weight adjusting means, e.g., an adjustable weight mount, for adjusting the weight on the door 84 so that a desired amount of pressure from the accumulated strands responsively causes the door 84 to open for discharge. This discharge downstream, for example, can be to a conveyor 90 or other downstream process as understood by those skilled in the art. It will also be understood by those skilled in the art that the size of the inner confines of the container 82 and the amount of weight holding the discharge door 84 in a closed or shut position has a impact on the number and size of undulations formed in the accumulated strands.

As illustrated in FIGS. 1–8, the present invention also advantageously provides methods of imparting a virtual twist to textile strand material. A method preferably includes guiding a plurality of strands S of textile strand material downstream through a strand guide 40 and rotatingly driving the strand guide 40 in only one direction between a strand twist position and a strand release position to thereby impart a virtual twist to the plurality of strands S of textile strand material.

This method also can include the strand guide 40 further having an opening 45 extending therethrough. The opening 45 includes narrower portions 46 and wider portions 47. The rotatingly driving step preferably includes respectively rotating the narrower and wider portions 46, 47 of the opening 45 about an axis A so that the plurality of strands S move, e.g., slidably move, between the narrower and wider portions 46, 47 during rotation of the strand guide 40 and so that the plurality of strands S being in the narrower portions 46 defines the twist position and the plurality of strands S being in the wider portions 47 defines the release position. The rotatingly driving step can include rotatingly driving the strand guide 40 at a plurality of speeds so as to impart a plurality of tightness levels or positions to the twist of the plurality of strands S. The strand guide 40 can be a first strand guide 40, and the method further includes adjustably positioning at least a second strand guide 56 upstream from the first strand guide 40 for guiding the plurality of strands S to the first strand guide 40 so that the adjustable position of the at least a second strand guide 56 adjusts the tightness of the twist imparted to the plurality of strands S by the rotatingly driving of the first strand guide 40. Also, a third strand guide 58 can be positioned between the first and the at least a second strand guide 40, 56 for guiding the plurality of strands S between the first strand guide 40 and the at least a second strand guide 56. This method can further include drawing the plurality of strands S downstream from and through the strand guide 40 during the rotatingly driving of the strand guide 40. The drawing step can include adjustably drawing the plurality of strands S downstream at a plurality of speeds.

Another method of imparting a virtual twist to textile strand material according to the present invention includes guiding textile strand material through a strand guide 40. The strand guide 40 includes an opening 45 for extending strand material therethrough. The opening 45 has wider portions 47 and narrower portions 46. The method also includes rotatingly driving the strand guide 40 in only one rotational direction so that strand material slidably moves between the wider and narrower portions 47, 46 of the opening 45 during rotation of the strand guide 40 to thereby impart a virtual twist to strand material.

This method also can include the rotatingly driving step rotatingly driving the strand guide 40 at a plurality of speeds so as to impart a plurality of tightness levels or positions to the twist of the plurality of strands S. The strand guide 40 also can be a first strand guide 40, and the method further includes adjustably positioning at least a second strand guide 56 upstream from the first strand guide 40 for guiding the plurality of strands S to the first strand guide 40 so that the adjustable position of the at least a second strand guide 56 adjusts the tightness of the twist imparted to the plurality of strands S by the rotatingly driving of the first strand guide 40. Also, a third strand guide 58 can be positioned between the first and the at least a second strand guides 40, 56 for guiding the plurality of strands S between the first strand guide 40 and the at least a second strand guide 56. This method can further include drawing the plurality of strands S downstream from and through the first strand guide 40 during the rotatingly driving of the first strand guide 40. The drawing step can include adjustably drawing the plurality of strands S downstream at a plurality of speeds.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus for imparting a virtual twist to textile strand material, the apparatus comprising:

a source of textile strand material;

drawing means positioned downstream from said textile strand material source for drawing strand material from said textile strand material source; and virtual twisting means positioned between said textile strand material source and said drawing means for applying a virtual twist to strand material being drawn by said drawing means, said virtual twisting means comprising a strand guide for guiding strand material supplied thereto and strand guide driving means connected to said strand guide for rotatingly driving said strand guide in only one rotational direction, said strand guide including an opening for extending strand material therethrough, said opening having wider portions and narrower portions so that strand material slidably moves between the wider and narrower portions during rotation of said strand guide to thereby impart a virtual twist to strand material.

2. An apparatus as defined in claim 1, wherein the opening of said strand guide further includes a throat portion positioned between the wider portions and the narrower portions for smoothly guiding the plurality of strands from the wider portions to the narrower portions during rotation of said strand guide.

3. An apparatus as defined in claim 1, wherein said strand guide further includes a guide body, said guide body of said strand guide comprising a main body member and a plate member detachably connected to said main body member, and wherein the opening of said strand guide extends through said main body member and said plate member.

4. An apparatus as defined in claim 3, wherein said plate member comprises a pair of spaced-apart plates each detachably connected to said main body member for adjustably forming an open space defined by the space extending between opposing peripheries of said spaced-apart plates, and wherein the opening comprises an elongate slot formed in said main body member and the open space extending between said space-apart plates being positioned to coaxially align with the elongate slot.

5. An apparatus as defined in claim 1, wherein said strand guide driving means includes a variable speed drive for adjustably driving said strand guide at a plurality of speeds so as to impart a plurality of tightness levels to the twist of the plurality of strands.

6. An apparatus as defined in claim 1, wherein said strand guide of said virtual twisting means comprises a first strand guide, and wherein the apparatus further comprises at least a second strand guide adjustably positioned between said strand supplying means and said first strand guide for guiding the plurality of strands from said strand supplying means to said first strand guide so that the adjustable position of said at least a second strand guide adjusts the tightness of the twist imparted to the plurality of strands by said virtual twisting means.

7. An apparatus as defined in claim 6, further comprising a third strand guide positioned between said first and said at least a second strand guide for guiding the plurality of strands between said first strand guide and said at least a second strand guide.

8. An apparatus as defined in claim 1, wherein said strand drawing means includes a plurality of draw rolls for drawing the plurality of strands downstream and draw roll driving means connected to said plurality of draw rolls for rotatingly driving said plurality of draw rolls.

9. An apparatus as defined in claim 8, wherein said draw roll driving means comprises a variable speed drive for adjustably driving said plurality of draw rolls at a plurality of speeds.

10. An apparatus as defined in claim 1, wherein the plurality of strands of strand material each include a synthetic fiber of yarn.

11. An apparatus for imparting a virtual twist to textile strand material, the apparatus comprising:

strand supplying means for supplying a plurality of strands of textile strand material; and virtual twisting means positioned downstream from said strand supplying means for virtually twisting the plurality of strands supplied from said strand supplying means so as to impart cohesiveness among the plurality of strands, said virtual twisting means comprising a strand guide positioned to guide the plurality of strands downstream and including a strand twist position and a strand release position and strand guide driving means connected to said strand guide for rotatingly driving said strand guide in only one direction so as to impart a twist to the plurality of strands when said strand guide is in the twist position and so as to release the twist of the plurality of strands when said strand guide is in the release position to thereby impart a virtual twist to the plurality of strands of textile strand material.

12. An apparatus as defined in claim 11, wherein said strand guide further includes a guide body having an opening extending therethrough so as to extend the plurality of strands through said guide body, the opening including narrower portions and wider portions which respectively rotate about an axis responsive to said strand guide driving means so that the plurality of strands move between the narrower and wider portions during rotation of said strand guide and so that the plurality of strands being in the narrower portions defines the twist position and the plurality of strands being in the wider portions defines the release position.

13. An apparatus as defined in claim 12, wherein the opening of said guide body further includes a throat portion positioned between the wider portions and the narrower portions for smoothly guiding the plurality of strands from the wider portions to the narrower portions during rotation of said strand guide.

14. An apparatus as defined in claim 12, wherein said guide body comprises a main body member and a plate member detachably connected to said main body member, and wherein the opening extends through said main body member and said plate member.

15. An apparatus as defined in claim 14, wherein said plate member comprises a pair of spaced-apart plates each detachably connected to said main body member for adjustably forming an open space defined by the space extending between opposing peripheries of said spaced-apart plates, and wherein the opening comprises an elongate slot formed in said main body member and the open space extending between said space-apart plates being positioned to coaxially align with the elongate slot.

16. An apparatus as defined in claim 11, wherein said strand guide driving means includes a variable speed drive for adjustably driving said strand guide at a plurality of speeds so as to impart a plurality of tightness levels to the twist of the plurality of strands.

17. An apparatus as defined in claim 11, wherein said strand guide of said virtual twisting means comprises a first strand guide, and wherein the apparatus further comprises at least a second strand guide adjustably positioned between said strand supplying means and said first strand guide for guiding the plurality of strands from said strand supplying means to said first strand guide so that the adjustable position of said at least a second strand guide adjusts the tightness of the twist imparted to the plurality of strands by said virtual twisting means.

18. An apparatus as defined in claim 17, further comprising a third strand guide positioned between said first and said at least a second strand guide for guiding the plurality of strands between said first strand guide and said at least a second strand guide.

19. An apparatus as defined in claim 11, further comprising strand drawing means positioned downstream from said virtual twisting means for drawing the plurality of strands downstream from said strand supplying means and through said strand guide of said virtual twisting means.

20. An apparatus as defined in claim 19, wherein said strand drawing means includes a plurality of draw rolls for drawing the plurality of strands downstream and draw roll driving means connected to said plurality of draw rolls for rotatingly driving said plurality of draw rolls.

21. An apparatus as defined in claim 20, wherein said draw roll driving means comprises a variable speed drive for adjustably driving said plurality of draw rolls at a plurality of speeds.

22. An apparatus as defined in claim 11, wherein said strand supplying means comprises a source of textile strand material, and wherein the plurality of strands of textile strand material each include a synthetic fiber of yarn.

23. An apparatus for imparting a virtual twist to textile strand material, the apparatus comprising:

a strand guide positioned to guide a plurality of strands downstream, said strand guide including a strand twist position and a strand release position; and strand guide driving means connected to said strand guide for rotatingly driving said strand guide in only one direction so as to impart a twist to the plurality of strands when said strand guide is in the twist position and so as to release the twist of the plurality of strands when said strand guide is in the release position to thereby impart a virtual twist to the plurality of strands of textile strand material.

24. An apparatus as defined in claim 23, wherein said strand guide further includes a guide body having an opening extending therethrough so as to extend the plurality of strands through said guide body, the opening including narrower portions and wider portions which respectively rotate about an axis responsive to said strand guide driving means so that the plurality of strands move between the narrower and wider portions during rotation of said strand guide and so that the plurality of strands being in the narrower portions defines the twist position and the plurality of strands being in the wider portions defines the release position.

25. An apparatus as defined in claim 24, wherein the opening of said guide body further includes a throat portion positioned between the wider portions and the narrower portions for smoothly guiding the plurality of strands from the wider portions to the narrower portions during rotation of said strand guide.

26. An apparatus as defined in claim 25, wherein said guide body comprises a main body member and a plate member detachably connected to said main body member, and wherein the opening extends through said main body member and said plate member.

27. A n apparatus as defined in claim 26, wherein said plate member comprises a pair of spaced-apart plates each detachably connected to said main body member for adjustably forming an open space defined by the space extending between opposing peripheries of said spaced-apart plates, and wherein the opening comprises an elongate slot formed in said main body member and the open space extending between said space-apart plates being positioned to coaxially align with the elongate slot.

28. An apparatus as defined in claim 27, wherein said strand guide driving means includes a variable speed drive for adjustably driving said strand guide at a plurality of speeds so as to impart a plurality of tightness levels to the twist of the plurality of strands.

29. An apparatus as defined in claim 28, wherein the plurality of strands of textile strand material each include a synthetic fiber of yarn.

30. An apparatus for imparting a virtual twist to textile strand material, the apparatus comprising:

a strand guide for guiding textile strand material supplied thereto, said strand guide including an opening for extending strand material therethrough, said opening having wider portions and narrower portions; and strand guide driving means connected to said strand guide for rotatingly driving said strand guide in only one rotational direction so that strand material slidably moves between the wider and narrower portions of said opening during rotation of said strand guide to thereby impart a virtual twist to strand material.

31. An apparatus as defined in claim 30, wherein the opening of said strand guide further includes a throat portion positioned between the wider portions and the narrower portions for smoothly guiding the plurality of strands from the wider portions to the narrower portions during rotation of said strand guide.

32. An apparatus as defined in claim 31, wherein said strand guide further includes a guide body, said guide body of said strand guide comprising a main body member and a plate member detachably connected to said main body member, and wherein the opening of said strand guide extends through said main body member and said plate member.

33. An apparatus as defined in claim 32, wherein said plate member comprises a pair of spaced-apart plates each detachably connected to said main body member for adjustably forming an open space defined by the space extending between opposing peripheries of said spaced-apart plates, and wherein the opening comprises an elongate slot formed in said main body member and the open space extending between said space-apart plates being positioned to coaxially align with the elongate slot.

34. An apparatus as defined in claim 33, wherein said strand guide driving means includes a variable speed drive for adjustably driving said strand guide at a plurality of speeds so as to impart a plurality of tightness levels to the twist of the plurality of strands.

35. An apparatus as defined in claim 30, wherein the textile strand material being guided by said strand guide includes a synthetic material.

36. A method of imparting a virtual twist to textile strand material, the method comprising:

guiding a plurality of strands of textile strand material downstream through a strand guide; and rotatingly driving the strand guide in only one direction between a strand twist position and a strand release position to thereby impart a virtual twist to the plurality of strands of textile strand material.

37. A method as defined in claim 36, wherein the strand guide further includes an opening extending therethrough, the opening including narrower portions and wider portions and wherein the rotatingly driving step includes respectively rotating the narrower and wider portions of the opening about an axis so that the plurality of strands move between the narrower and wider portions during rotation of the strand guide and so that the plurality of strands being in the narrower portions defines the twist position and the plurality of strands being in the wider portions defines the release position.

38. A method as defined in claim 36, wherein the rotatingly driving step includes rotatingly driving the strand guide at a plurality of speeds so as to impart a plurality of tightness levels to the twist of the plurality of strands.

39. A method as defined in claim 36, wherein the strand guide comprises a first strand guide, and the method further comprising adjustably positioning at least a second strand guide upstream from the first strand guide for guiding the plurality of strands to the first strand guide so that the adjustable position of the at least a second strand guide adjusts the tightness of the twist imparted to the plurality of strands by the rotatingly driving of the first strand guide.

40. A method as defined in claim 39, positioning a third strand guide between the first and the at least a second strand guide for guiding the plurality of strands between the first strand guide and the at least a second strand guide.

41. A method as defined in claim 36, further comprising drawing the plurality of strands downstream from and through the strand guide during the rotatingly driving of the strand guide.

42. A method as defined in claim 41, wherein the drawing step includes adjustably drawing the plurality of strands downstream at a plurality of speeds.

43. A method of imparting a virtual twist to textile strand material, the method comprising:

guiding textile strand material through a strand guide, the strand guide including an opening for extending strand material therethrough, the opening having wider portions and narrower portions; and rotatingly driving the strand guide in only one rotational direction so that strand material slidably moves between the wider and narrower portions of the opening during rotation of the strand guide to thereby impart a virtual twist to strand material.

44. A method as defined in claim 43, wherein the rotatingly driving step includes rotatingly driving the strand guide at a plurality of speeds so as to impart a plurality of tightness levels to the twist of the plurality of strands.

45. A method as defined in claim 43, wherein the strand guide comprises a first strand guide, and the method further comprising adjustably positioning at least a second strand guide upstream from the first strand guide for guiding the plurality of strands to the first strand guide so that the adjustable position of the at least a second strand guide adjusts the tightness of the twist imparted to the plurality of strands by the rotatingly driving of the first strand guide.

46. A method as defined in claim 45, positioning a third strand guide between the first and the at least a second strand guide for guiding the plurality of strands between the first strand guide and the at least a second strand guide.

47. A method as defined in claim 43, further comprising drawing the plurality of strands downstream from and through the strand guide during the rotatingly driving of the strand guide.

48. A method as defined in claim 47, wherein the drawing step includes adjustably drawing the plurality of strands downstream at a plurality of speeds.

* * * * *